US007217064B1

(12) United States Patent
Wilson

(10) Patent No.: US 7,217,064 B1
(45) Date of Patent: May 15, 2007

(54) REINFORCEMENT OF ARCH TYPE STRUCTURE WITH BEVELED/SKEWED ENDS

(76) Inventor: Michael W. Wilson, 13 Silvershore Dr., Sackville, New Brunswick (CA) E47 1M7

( * ) Notice: Subject to any disclaimer, the term of this patent is extended or adjusted under 35 U.S.C. 154(b) by 0 days.

(21) Appl. No.: 11/317,590

(22) Filed: Dec. 23, 2005

(51) Int. Cl.
*E21D 11/00* (2006.01)

(52) U.S. Cl. ..... 405/132; 405/124; 405/125; 405/149

(58) Field of Classification Search ..... 405/149, 405/132, 124–126
See application file for complete search history.

(56) References Cited

U.S. PATENT DOCUMENTS

| | | | | |
|---|---|---|---|---|
| 944,592 | A | 12/1909 | Bonsall | |
| 1,999,500 | A | 4/1935 | Carswell | |
| 4,099,359 | A | 7/1978 | Sivachenko | |
| 4,099,386 | A | 7/1978 | Sagasta | |
| 4,186,541 | A | 2/1980 | Sivachenko | |
| 4,318,635 | A | 3/1982 | Gurtner et al. | |
| 4,618,283 | A * | 10/1986 | Hilfiker | 405/124 |
| 5,207,038 | A * | 5/1993 | Negri | 405/149 |
| 5,833,394 | A | 11/1998 | McCavour | |
| 6,050,746 | A | 4/2000 | McCavour | |
| 6,434,892 | B1 * | 8/2002 | Heierli | 405/125 |
| D484,609 | S | 12/2003 | Harrington et al. | |
| 6,854,928 | B2 * | 2/2005 | Lockwood | 405/124 |
| 6,874,974 | B2 * | 4/2005 | VanBuskirk et al. | 405/124 |
| 2004/0062609 | A1 * | 4/2004 | Heierli | 405/124 |

* cited by examiner

*Primary Examiner*—Frederick L. Lagman
(74) *Attorney, Agent, or Firm*—Barnes & Thornburg, LLP

(57) ABSTRACT

A method for controlling deformation of a cut end region of an erected arch-type structure for use in underpass construction and the like where the cut end region has at least one extended leg portion. The method comprises building progressively at least one layer of mechanically-stabilized earth adjacent the extended leg portion by alternately layering a plurality of compacted layers of fill with interposed layers of reinforcement. Each layer of reinforcement is secured to the extended leg portion during the progressive building. The securement of the layers of reinforcement to the extended leg portions provide support in controlling deformation of the cut end region during backfilling and regular service.

20 Claims, 14 Drawing Sheets

REINFORCEMENT OF ARCH TYPE STRUCTURE WITH BEVELED/SKEWED ENDS

FIELD OF THE INVENTION

This invention generally relates to structural metal plate arch-type structures. In particular, this invention relates to a method for controlling deformation of a cut end region of an erected arch-type structure for use in underpass construction and the like, where the cut end region has at least one extended leg portion.

BACKGROUND OF THE INVENTION

As rural and urban infrastructure continues to age and develop, there is a continual demand for cost-effective technologies relating to the construction and maintenance of highways, railways and the like. Often unappreciated but vitally important to the construction of such infrastructure is the underpass system. Underpass systems are typically designed to carry not only dead loads, but also live loads. While some of the most impressive underpass systems are used in mining or forestry applications where spans can exceed 20 m, they are also very common in regular highway construction to allow passage of railway, watercourses or other vehicular/pedestrian traffic. While concrete structures have been regularly employed for these purposes, they are very expensive to install, are cost prohibitive in remote areas and are subject to strength weakening due to corrosion of the reinforcing metal and hence, repair.

In the field of arch-type structures, there have been significant advances in respect of the use of corrugated metal culverts, arch culverts and box culverts. For example, U.S. Pat. No. 5,118,218 discloses the use of sheets of metal having exceptionally deep corrugations where by, using significant material on the crown portions of the culvert and perhaps as well in the haunch portions of the culvert, significant loads can be carried by the culvert design. Ovoid and circular structures are described in U.K. Patent Application No. 2,140,848 where wing members are used to increase the load carrying capabilities, and in particular avoid bending of the crown or roof structure as live loads pass thereover.

U.S. Pat. No. 5,326,191 discloses a reinforced metal box culvert which is provided with a special form of continuous reinforcement along at least the crown or top portion of the culvert. Significant advantages are provided in load carrying characteristics, reduced overburden requirements and the ability to provide large span structures that reduce the cost. These systems greatly facilitate the installation of large span structures with the ability to carry live loads under a variety of conditions. Improvements to the box culvert and arch culvert designs are also described in U.S. Pat. No. 5,375,943 and International PCT Application No. PCT/CA97/00407.

The use of mechanically-stabilized earth in archway construction is described in U.S. Pat. No. 4,618,283. This construction technique avoids arching of the structure because the sidewalls of the archway are built as successive layers of mechanically-stabilized earth which are deposited along side and over top of the structure. The technique involves building on each side of the archway mechanically-stabilized earth which constitutes vertical support sections, and then building across the top of the arch again using mechanically-stabilized earth to define the roof of the archway. As the archway is built step-by-step, facings are applied to contain the mechanically-stabilized earth and prevent such compacted unbound fill of the mechanically-stabilized earth structure from coming loose and falling into the archway. Such facing may be simply attached to the vertical portions of the wire mesh which terminate at the edge of the archway envelope. Alternatives to the facing material include spraying of concrete to provide a liner within the archway or the use of a corrugated metal liner. Optionally, the facing of the mechanically-stabilized earth vertical structures may be attached to the corrugated metal liner. The liner is not designed to carry any structural load either live or dead, instead the live and dead loads are carried by the mechanically-stabilized earth vertical support sections as well as the mechanically-stabilized earth roof section.

A further method for controlling deformation of an erected structure, principally during the backfilling process is described in U.S. Pat. No. 6,050,746.

SUMMARY OF THE INVENTION

Accordingly, in one aspect, there is provided a method for controlling deformation of a cut end region of an erected arch-type structure for use in underpass construction and the like, where the cut end region has at least one extended leg portion, said method comprising:

i) building progressively at least one layer of mechanically-stabilized earth adjacent said extended leg portion by alternately layering a plurality of compacted layers of fill with interposed layers of reinforcement; and ii) securing to said extended leg portion each layer of reinforcement during said progressive building, whereby securement of said layers of reinforcement to said extended leg portions provide support in controlling deformation of the cut end region during backfilling and regular service.

BRIEF DESCRIPTION OF THE DRAWINGS

Preferred embodiments are described with respect to the drawings wherein.

DETAILED DESCRIPTION OF THE PREFERRED EMBODIMENTS

The construction of underpass systems or similar thoroughfare infrastructure using large and/or long span metal arch-type structures presents certain challenges. As one can appreciate, these structures are subject to extreme stresses, not only during the intended use (i.e. anticipated live/dead loads), but also during the initial construction process. Technology has enabled the construction of larger and longer structures, as evidenced by U.S. Pat. Nos. 5,326,191 and 5,375,943 and International PCT Applications No. PCT/CA97/00407, assigned to the assignee of the subject application. With larger structures, the susceptibility of deformation and/or failure due to extreme forces imparted during the backfill process has required further technological development, as evidenced by U.S. Pat. No. 6,050,746, assigned to the assignee of the subject application. With the core technology now available to provide a wide-ranging number of applications, new challenges have presented themselves.

With arch-type structures not comprising beveled or skewed ends, the structural metal plates at each end region are configured to form a complete span defining the effective topside circumference of the structure. It will be appreciated that these complete spans provide a degree of stability to the structure. In many applications, however, there is a requirement for such structures to have beveled/skewed ends, whether it is simply a matter of aesthetics, or for specific properties such as hydraulics relating to a watercourse passing therethrough. In such structures comprising a bevel/skew, the structural metal plates are truncated at the end region, resulting in a lack of stability. As such, these arch-type structures are at increased risk of deformation due to pressures exerted by backfill and standard loads experienced during regular use. While beveled/skewed structures are known, their installations have traditionally required reinforcement using steel, concrete or tie-back arrangements (i.e. steel rods tied to an anchoring device) to provide the necessary support. It has been found that these various ways to provide reinforcement are labor intensive and can substantially increase the overall cost of installing such a structure.

Figure 1:
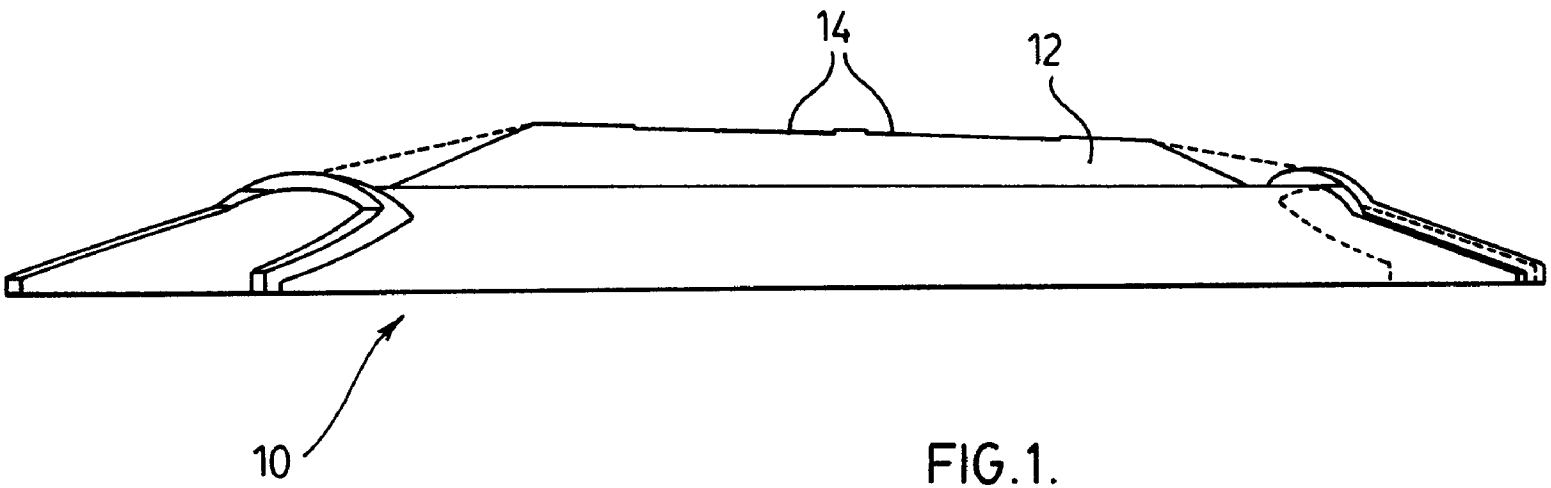
FIG. 1 is a perspective view of a representative type of beveled/skewed arch-type structure.
Figure 2:
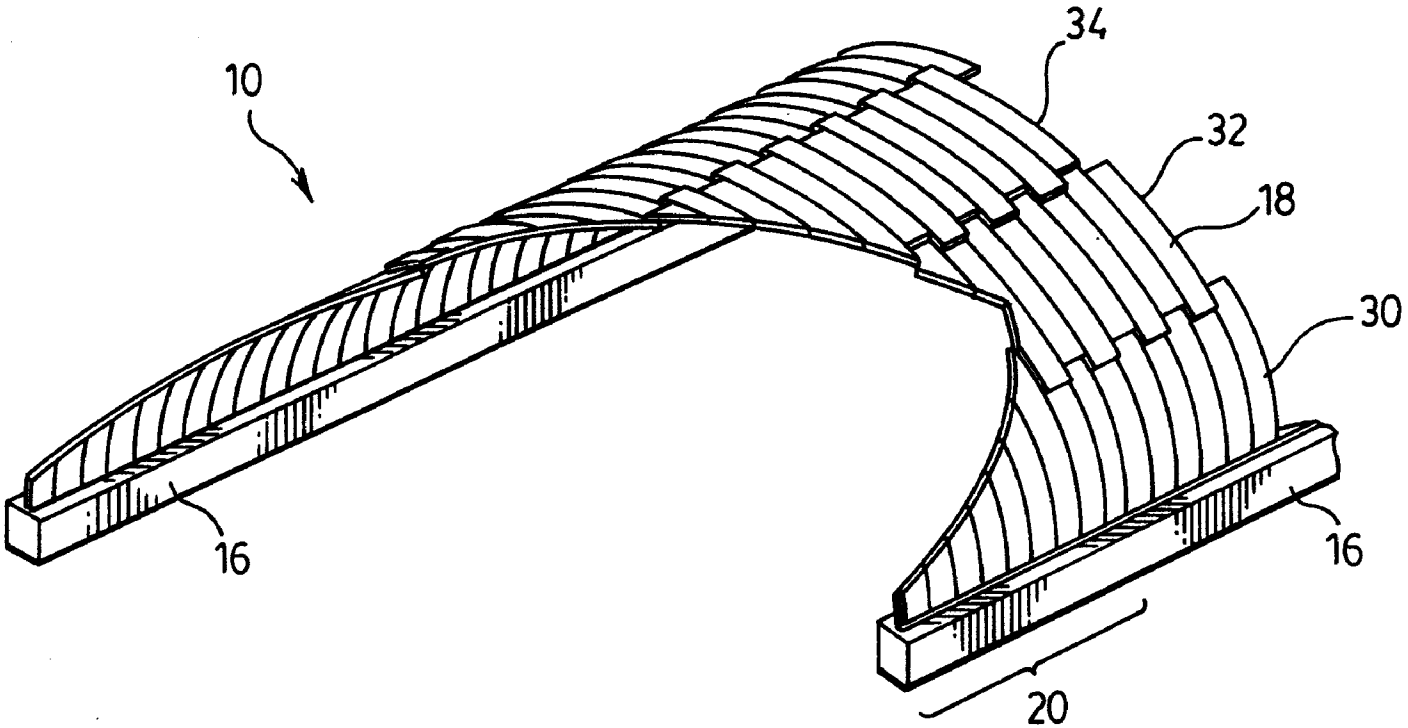
FIG. 2 is a partial perspective view of the cut end region of the arch-type structure of FIG. 1.

A representative underpass or similar thoroughfare infrastructure comprising a metal arch-type structure 10 constructed of structural metal plate is shown in FIG. 1. Above the metal arch-type structure 10 is a prescribed depth of overburden 12, on top of which is a roadway 14 constructed in a usual manner. As better shown in FIG. 2, the structure 10 is generally comprised of a pair of footings 16 and a plurality of structural metal plates 18. In the preferred embodiment, the structural metal plates 18 are corrugated. The structural metal plates 18 are fastened together so as to achieve the desired erected structure. While the preferred method of fastening is to bolt the various plates together, it will be appreciated that other alternate suitable fasteners that meet the specific structural and load requirements (welds, rivets, etc. . . . ) can be used.

Figure 3:
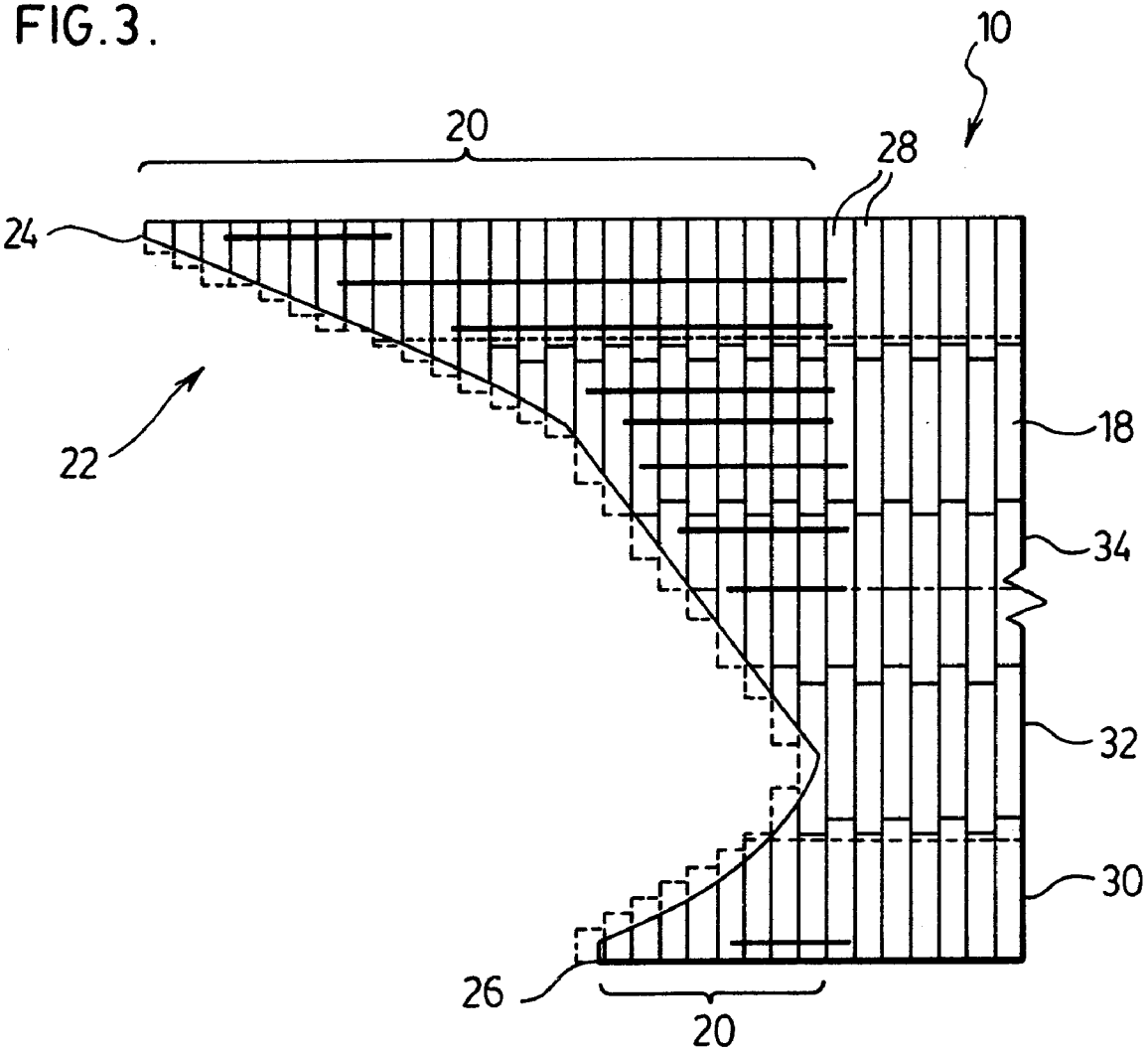
FIG. 3 is a partial top view of the cut end region of the arch-type structure of FIG. 1.

In FIG. 3, shown is a top view of the arch-type structure 10 comprising a cut end region 22 having both a beveled and skewed configuration. The arch-type structure 10 is comprised of a plurality of interconnected structural metal plates 18 fastened together in staggered stepwise arrangement to achieve the desired erected structure. Note the truncated structural metal plates 20 at the cut end region 22. With the arch-type structure 10 being both beveled and skewed, there is defined at the cut end region 22 both a long leg portion 24, and a short leg portion 26. To ensure structural integrity during the construction process, it is advisable to first assemble at least two complete spans 28 of metal plates comprising the sidewalls 30, haunch 32 and crown 34 (see FIG. 2) and have these affixed to the respective footings 16 before proceeding with the assembly of the cut end region 22. Once fastened in place, the cut end region 22 comprising the truncated structural metal plates 20 are erected using plate-by-plate assembly. If necessary, in certain applications, extra temporary support may be used.

During the backfilling process, as mentioned above, the cut end region 22 is susceptible to deformation and/or failure before installation is complete. This is particularly true for structures in which the sidewalls 30 are vertically extended. To enable backfilling in the cut end region 22, the truncated structural metal plates 20 are reinforced in accordance with the method shown in FIGS. 4*a* and 4*b*.

Figure 4A:
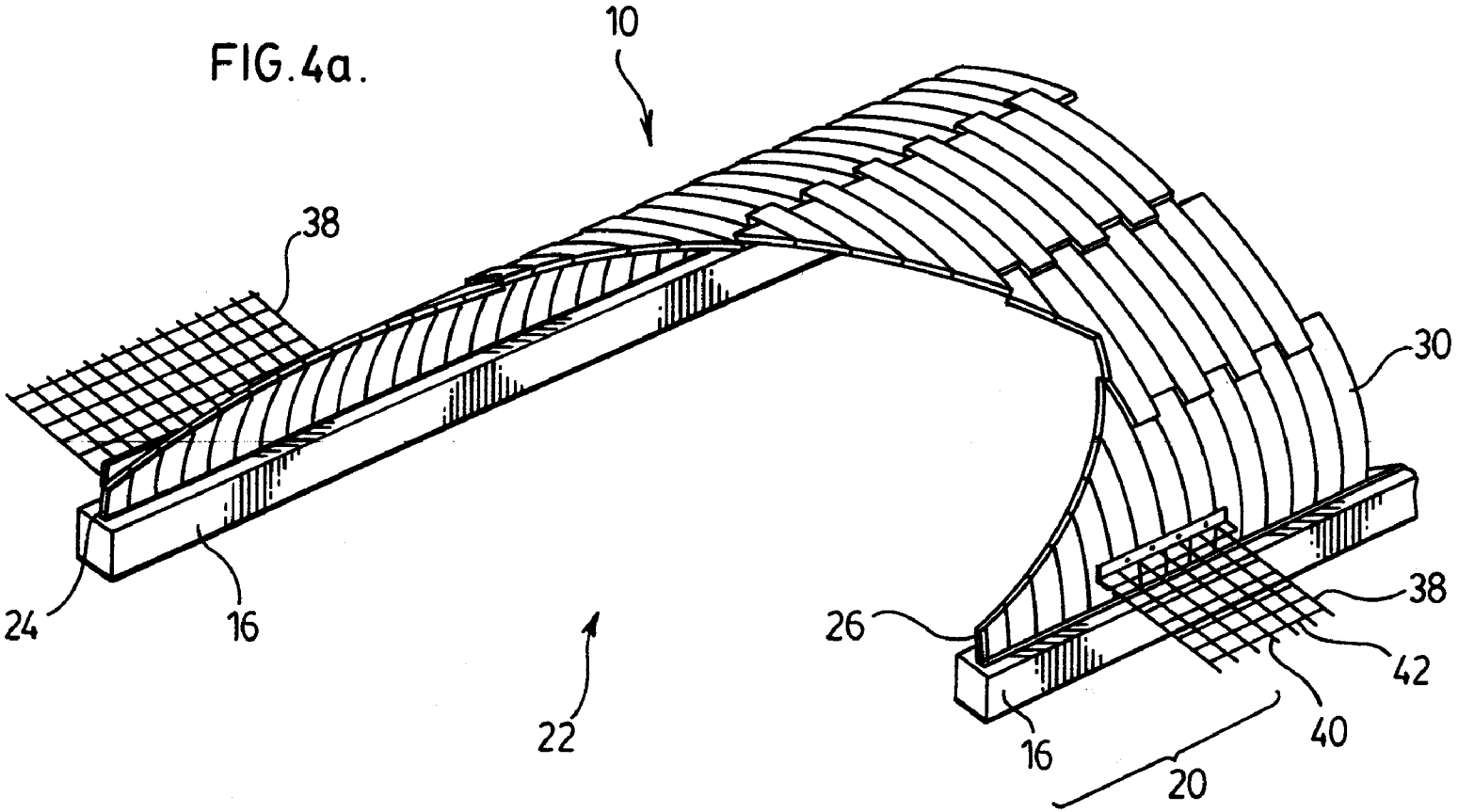
FIG. 4*a* is a partial perspective view of the cut end region of the arch-type structure of FIG. 1 showing a single layer of the wire grid mat reinforcement.
Figure 4B:
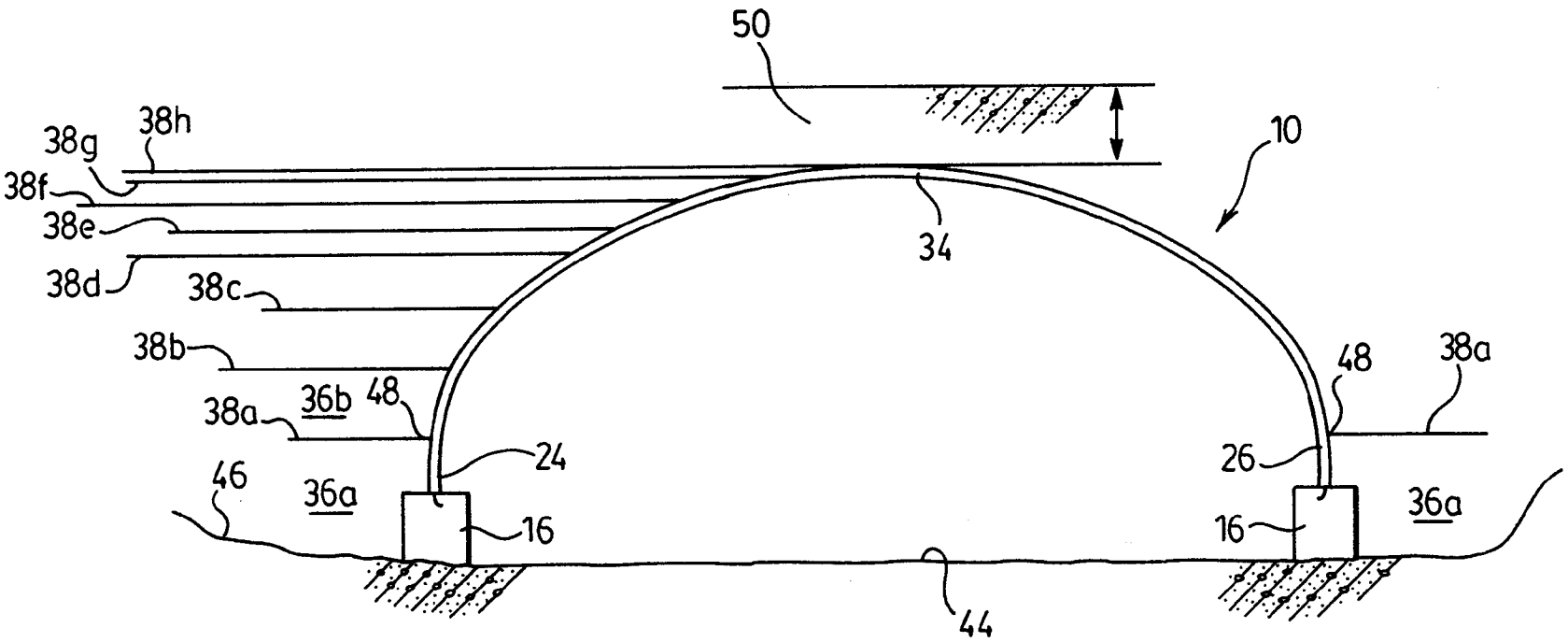
FIG. 4*b* is a partial front view of the arch-type structure of FIG. 1, showing the consecutive layers of backfill and reinforcement on each side of the arch-type structure.

As shown in FIGS. 4*a* and 4*b*, mechanically-stabilized earth is installed on each side of the cut end region 22 of the arch-type structure 10 in a manner which minimizes deformation of this region during backfilling. Mechanically-stabilized earth has been used extensively in providing retaining walls, headwalls and the like such as described in the aforementioned U.S. Pat. No. 4,618,283.

In the cut end region 22, the mechanically-stabilized earth is developed by alternately layering a plurality of compacted layers of fill 36 with interposed layers of reinforcement 38 to form the mechanically-stabilized earth as shown in FIG. 4*b*. In the preferred embodiment, the reinforcement layers each comprise a wire grid mat (see FIG. 4*a*), formed of a plurality of interconnected intersecting rods 40 and 42. Fill is provided on top of the excavation bed 44 and along the slopes 46 to form a first layer 36*a* of compacted fill. The fill may be any type of granular material such as various types of sand, gravel, broken rock and the like. The unbound fill even when compacted remains granular and has a relatively low resistance to sheer forces. After the first layer of compacted fill is installed a layer of reinforcement 38*a* is laid down where that layer of reinforcement 38*a* is connected to the sidewalls 48 of the extended short and long leg portions of the cut end region 22, so as to secure the layer of reinforcement 38*a* to the sidewalls 48. Such manner of connection to the truncated structural metal plates will be described further below. The next layer of fill 36*b* is then applied over top of the reinforcement layer 38*a*. After the layer of fill 36*b* is completed the next layer of reinforcement 38*b* is laid down over top this layer of compacted fill 36*b*. Reinforcement layer 38*b* is also connected to the sidewalls as described above. This procedure is repeated several times as required to backfill the excavated space between the slopes 46 and the sidewalls 48 of the arch-type structure 10. In the structure shown in FIG. 4*b*, the long leg portion 28 has eight (8) reinforcement layers 38*a*, 38*b*, 38*c*, 38*d*, 38*e*, 38*f*, 38*g* and 38*h* attached to it, and the short leg portion 26 has one reinforcement layer 38*a* attached to it. The backfilling is then completed to the level of the crown and the usual overburden 50 is then applied.

Overburden 50 is developed in the usual manner such that when the overburden is in place, both the live and dead loads applied to the structure are accommodated by the capacity of the structural metal plate. For example, with the design criteria set out in assignee's above noted U.S. patents and International application, the live and dead loads are accommodated by the backfilled structure in the usual manner where the loads are resisted by the structural strength of the metal plate, as well as the backfill resisting outward movement of the sidewalls which is commonly referred to as "Positive Arching."

As shown in FIGS. 4*a* and 4*b*, for an arch-type structure having both a beveled and skewed profile, the use of reinforcement layers on each leg extension may not be symmetrical. As can be appreciated, the short leg portion 26 will require less reinforcement as there are fewer truncated structural metal plates 20 to support. As shown for the arch-type structure represented, the short leg portion 26 receives one reinforcement layer 38*a*, whereas the long leg portion 24 receives eight (8) reinforcement layers 38*a* through 38*h*.

By following the procedure of this method the reinforced soil system controls deformation and/or failure of the cut end region 22 of the arch-type structure 10. It will be appreciated, however, that while reinforcement has only been provided in the region of the bevel/skew, it may also be advantageous to provide reinforcement at other regions of the structure as well. As described in assignee's U.S. Pat. No. 6,050,746, which is herein incorporated by reference, reinforcement of the structure may also be configured to provide only an interim function which becomes obsolete at the end of the backfilling operation.

Figure 5A:
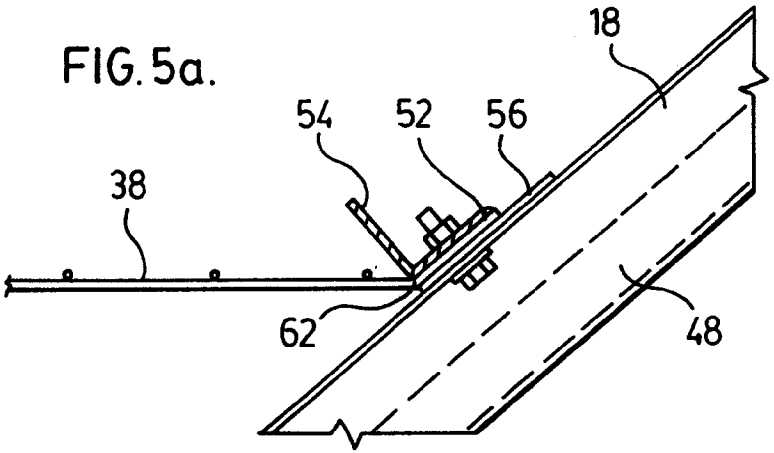
FIG. 5*a* is a side sectional view through a portion of the arch-type structure of FIG. 1, showing greater detail of the connection of the reinforcement to the sidewall.
Figure 5B:
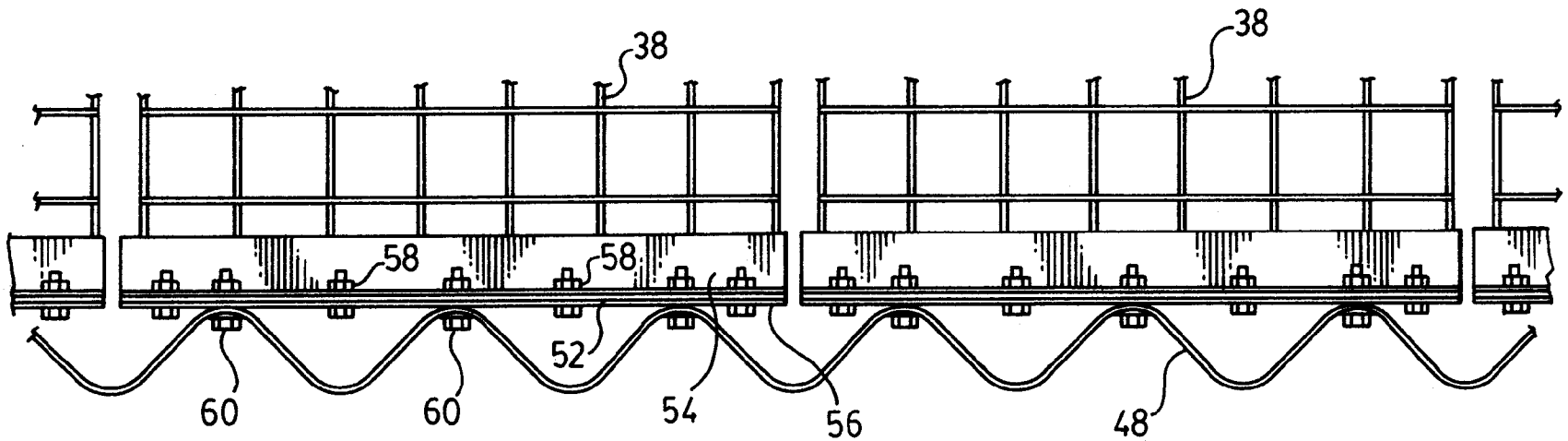
FIG. 5*b* is a top sectional view through a portion of the arch-type structure of FIG. 1, showing the placement of a pluarlity of reinforcements on the sidewall.

While a variety of methods can be used for connecting the reinforcement to the sidewall, in the preferred embodiment represented in FIGS. 5*a* and 5*b*, an end section 52 of the reinforcement 38 is fixedly retained between a length of angle iron 54 and a length of flat bar 56. As better shown in FIG. 5*b*, a first set of fasteners 58 are used to capture the reinforcement 38 between the angle iron 54 and flat bar 56, while a second set of fasteners 60 are used to impart further clamping pressure, while also attaching the angle iron 54 and flat bar 56 to the sidewall 48 of the structural metal plate 18. Use of the angle iron 54 and length of flat bar 56 ensures distribution of load across the corrugations of the sidewall of the extended leg portions, reducing the likelihood of deformation and localized failure due to point loads associated with prior art tie-back systems. The reinforcement 38 is configured at point 62 with a bend such that the extending portion of the reinforcement 38 lays in a generally horizontal position. While the reinforcement 38 generally extends laterally away from the structure in a generally horizontal position, other non-horizontal configurations may be possible, if for example certain obstructions are present in the backfill zone.

Figure 6A:
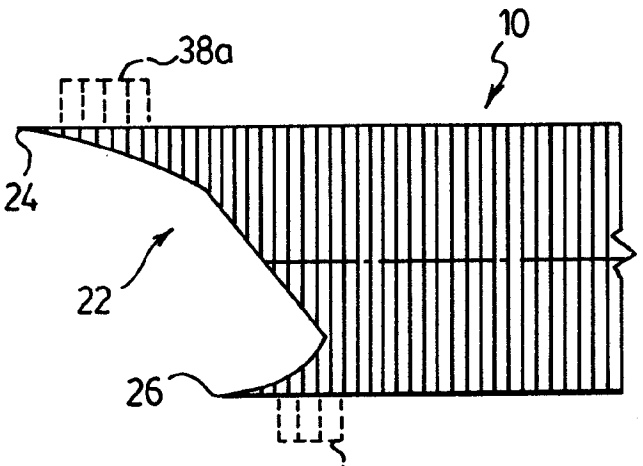
FIGS. 6*a*, 6*b*, 6*c* and 6*d* are sequential elevational views showing placement of the reinforcements at the cut end region of the arch-type structure of FIG. 1.
Figure 6B:
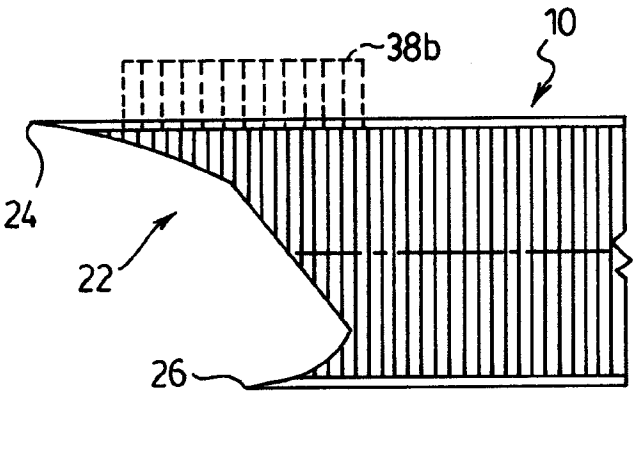
Figure 6C:
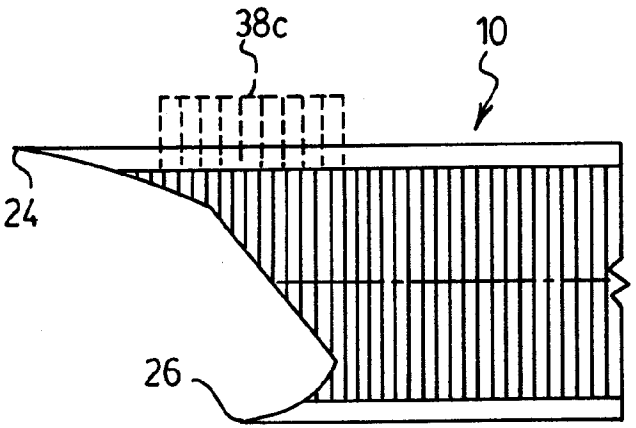
Figure 6D:
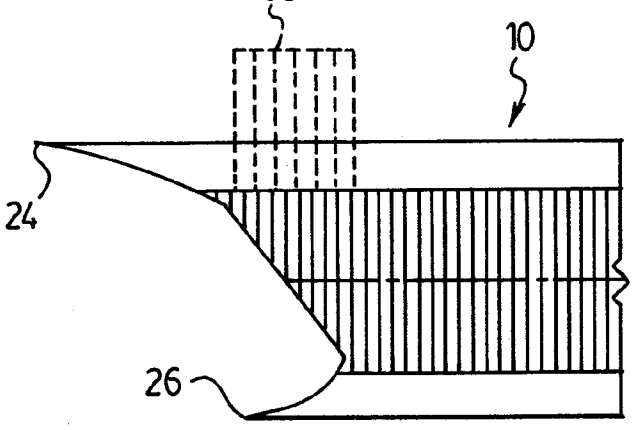

FIGS. 6*a* to 6*d* show a series of successive elevational views illustrating placement of the reinforcement 38 relative to the cut end region 22. As will be noted, the reinforcement 38 is generally present as a pluarlity of reinforcements (i.e. a pluarlity of wire grid mats), but it will be appreciated that any number from a single unit through to a large number can be used, depending on the particular support requirements. Referring specifically to FIG. 6*a*, shown on the short leg portion 26 is a reinforcement layer 38*a* comprising three adjacently positioned wire grid mats. On the long leg portion 24, the reinforcement layer 38*a* comprises four adjacently positioned wire grid mats. Further, the length of each of the reinforcements can be tailored to the particular application, depending on the support requirements and the available space between the structure and any adjacent structure, or the slopes of the excavated area. Reference is made to FIG. 6*d* which shows a reinforcement 38*d* that not only comprises six (6) wire grid mats, but mats that are approximately three (3) times longer than those in FIG. 6*a*. FIGS. 6*b* and 6*c* show intermediate reinforcement layers 38*b* and 38*c*, respectively. The length and quantity of reinforcements will be a factor of the particular situation in which they are being installed. As a general rule, reinforcements may be configured with a length that is approximately 70% of the height of the wall. In situations where there is low cover (i.e. close to the top of the structure), the mats may be lengthened to increase the frictional capacity of the mat itself. Approaching the base of the structure, the mats may be shortened as they are subject to higher frictional forces. Also, in certain situations it may be necessary to increase the diameter of the rods used to construct the wire grid mat so as to handle higher forces and resist tearing under extreme load. As mentioned, the above are general guidelines and in no way are meant to be interpreted as limitations to the configuration of the reinforcement mats. In actual practice, the specifics of the installation, the expected loads and the engineered capacity of the structure will dictate the final configuration of these reinforcements.

Figure 7:
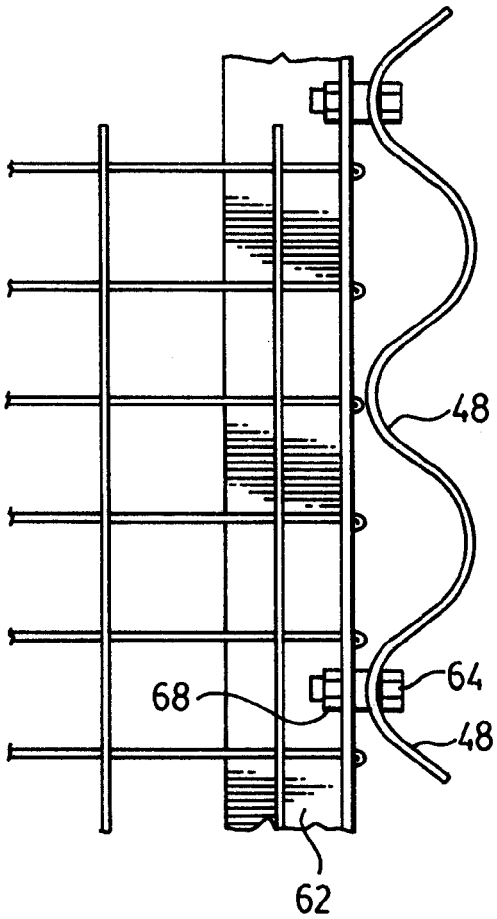
FIG. 7 is a top sectional view through a portion of the arch-type structure showing an alternate embodiment for connecting the reinforcement to the sidewall.

While the above discussed method for connecting the reinforcement to the sidewall is preferred, one skilled in the art may choose to implement a suitable alternative. The following presents a number of alternatives for achieving this connection. Referring to the structure shown in FIG. 7, the reinforcement 38 once again takes the form of the preferred wire grid mat. The longitudinal rods are connected in accordance with the embodiments of FIGS. 8*a* to 8*d* or 9*a* to 9*e* to a length of structural material (i.e. angle iron) which distributes the loads along the sidewall of the extended leg portions. This reduces the likelihood of deformation due to point loads associated with prior art tie-back systems. As shown, the angle iron 62 is bolted at 64 to the interconnected structural metal plates 48. Bolts are normally used to connect the plates 48; hence, a second nut 68 may be used to connect the angle iron to the bolt 64 in assembling the structure.

Figure 8A:
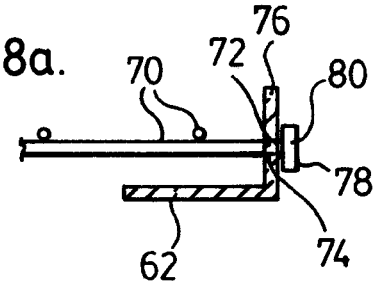
FIGS. 8*a*, 8*b*, 8*c* and 8*d* are sections through alternate embodiments for connecting the reinforcement to the sidewall.
Figure 8B:
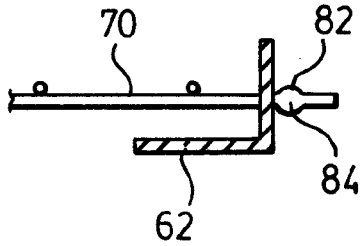
Figure 8C:
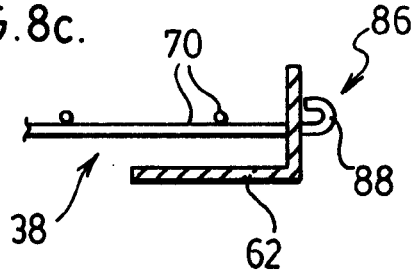
Figure 8D:
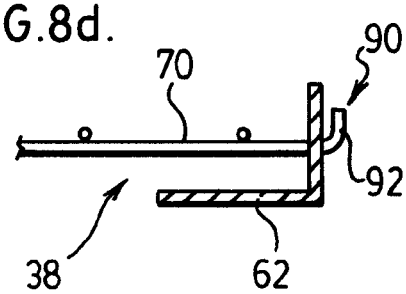

The alternate embodiments of FIGS. 8*a* to 8*d* and 9*a* to 9*e* show various types of connection of the reinforcement to the angle iron 62. As shown in FIG. 8*a*, the longitudinally extending rods 70 have their end portions 72 extend through an opening 74 in the upright portion 76 of the angle iron. The distal end 78, of each longitudinally extending rod 70 is then deformed to provide a button 80, which is greater than the opening 74 in the upright portion, so as to retain the reinforcement in the angle iron. The deformation of the distal end and forming the button 80, is such to accommodate both the tensile stress applied to the reinforcement during the backfilling operation, as well as the expected stresses due to normal usage of the structure. As shown in FIG. 8*b* the distal end 82 of the longitudinally extending rod 70 is flattened to define a butterfly button 84 which holds the rod in place. A shown in FIG. 8*c* the distal end 86 is bent upon itself to define an enlarged end 88 which retains the reinforcement 38. As shown in FIG. 8*d*, the distal end 90 is bent upwardly to form leg 92 which retains the reinforcement in place in the angle iron 62.

Figure 9A:
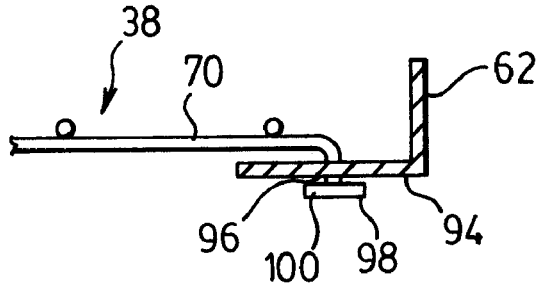
FIGS. 9*a*, 9*b*, 9*c*, 9*d* and 9*e* are sections through alternate embodiments for the reinforcement connection.
Figure 9B:
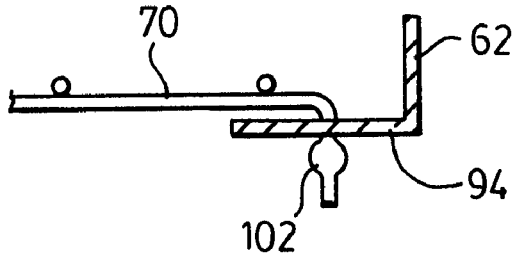
Figure 9C:
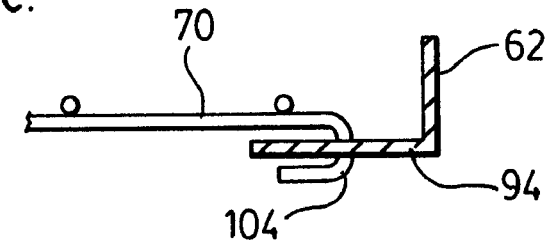
Figure 9D:
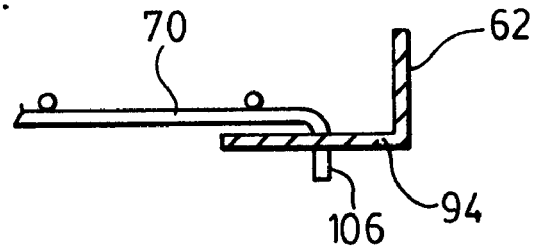
Figure 9E:
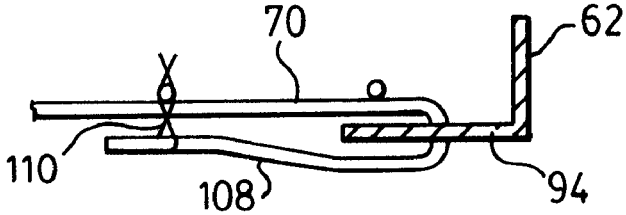

As shown in FIGS. 9*a* to 9*e*, alternative arrangements may be used where the reinforcement 38 has the longitudinally extending rods 70 secured to the lower leg 94 of the angle iron 62. The lower leg 94 has an opening 96 formed therein to accommodate the rod 70 and has at its distal end 98 a deformed button 100 to secure the rod in place. Similarly with embodiments of FIGS. 9*b*, 9*c* and 9*d*, the respective distal end is deformed to secure the rod 70 in the lower leg portion 94. In FIG. 9*b*, the distal end is flattened to define a butterfly button 102 which holds the rod 70 in place. In FIG. 9*c*, the distal end is bent upon itself to define and enlarged end 104 which retains the rod 70 in place. In FIG. 9*d*, the distal end is bent downwardly to form leg 106 which retains the rod 70 in place. In the embodiment in FIG. 9*e* the rod 70 is bent upon itself at 108 and secured in place by rod wire 110.

Figure 10A:
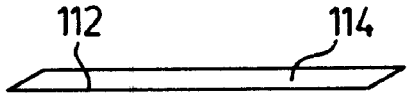
FIGS. 10*a* to 10*l* are top plan views of various types of reinforcement.
Figure 10B:
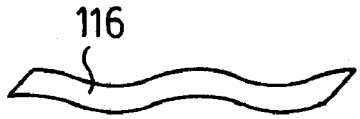
Figure 10C:
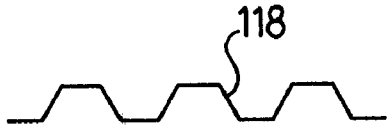
Figure 10D:
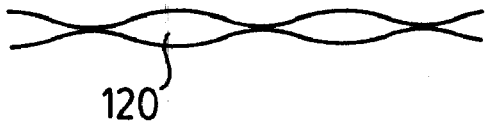
Figure 10E:
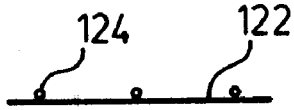
Figure 10F:
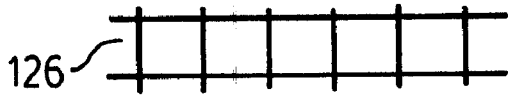
Figure 10G:
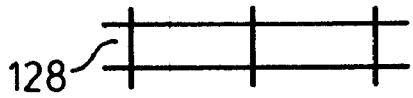

It should be appreciated that the reinforcement layer interposed at each compacted layer of fill for the reinforced soil may take on a variety of structures and shapes. In addition to the preferred wire grid structure set out above, it will be understood that other types of reinforcement may be used such as, individual strips 112 (see FIGS. 10*a* to 10*l*). As shown in FIG. 10*a*, each end 114 of the strip is connected to the sidewall either directly or via a load distributing device such as the angle iron 62 of FIG. 7. This type of strip is very common to the system originally developed by "VIDAL" which is described for example in French Pat. No. 75/07114 published Oct. 1, 1976. As shown in FIG. 10*b* the strip 116 may be corrugated to enhance its load carrying capacity. An alternate corrugated strip 118 is shown in FIG. 10*c*; a spiral strip 120 is shown in FIG. 10*d*. In FIG. 10*e* the reinforcement may be rods 122 with enlargements 124. Alternatively, ladder-like strips 126 and 128 may be used such as in FIGS. 10*f* and 10*g*.

Figure 10H:
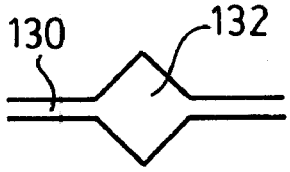
Figure 10I:
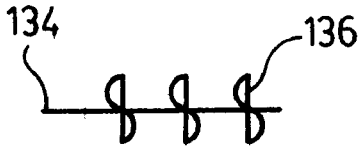
Figure 10J:
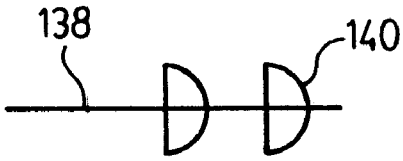
Figure 10K:
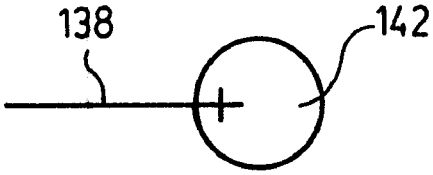
Figure 10L:
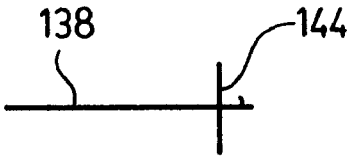

The strips may also have enlarged portions such as shown in FIG. 10*h* for strip 130 with enlarged sections 132. Alternatively, the strip 134 FIG. 10*i* may have auger or propeller shaped units 136, as shown in FIG. 10*i*. The outwardly extending rods 138 of FIGS. 10*j*, 10*k* and 10*l* may have enlarge disks 140, enlarged concrete masses 142 or flat plate 144 connected thereto to anchor the strips in the compacted fill. Alternatively, the strips, as well as the aforementioned wire grid mat may be configured to anchor into surrounding rock using suitable rock anchors.

Figure 11A:
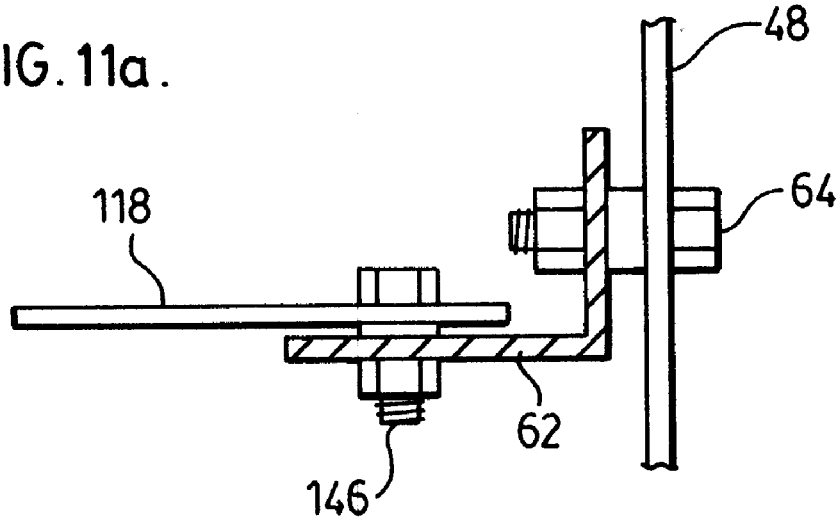
FIGS. 11*a* and 11*b* show an alternate embodiment for connecting the reinforcement to the sidewall.
Figure 11B:
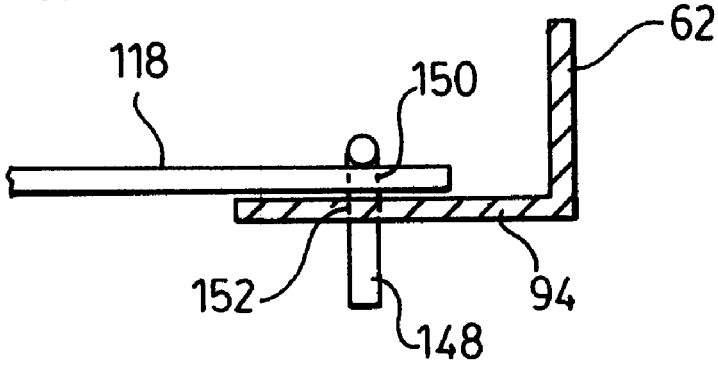

With respect to the use of strips as reinforcement, the load distributing member 62, which is in the form of an angle iron is connected to the sidewall 74 of the plate 48 by bolts 64 as shown in FIG. 11*a*. The strip for example 112 is then bolted to the angle iron 62 by bolt 146 to complete the connection. Alternatively, in FIG. 11*b* the angle iron 62 may have the strip 118 connected thereto by the use of a pin 148, which extends through aperture 150 in the strip and aperture 152 in the leg 94 of the angle iron 62.

Figure 12A:
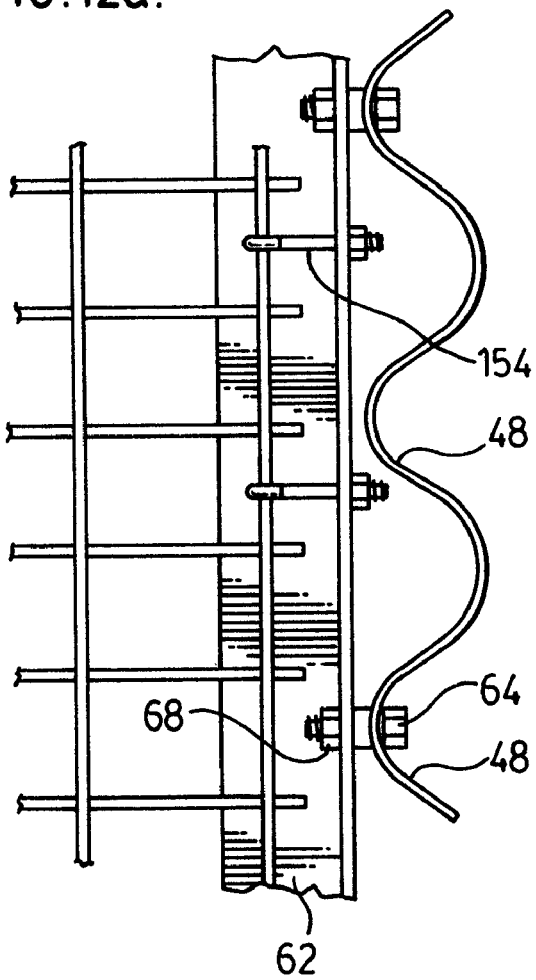
FIGS. 12*a* and 12*b* show a further alternate embodiment for connecting the reinforcement to the sidewall.
Figure 12B:
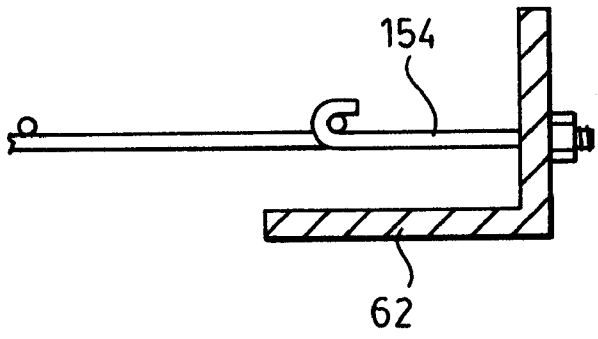
Figure 13A:
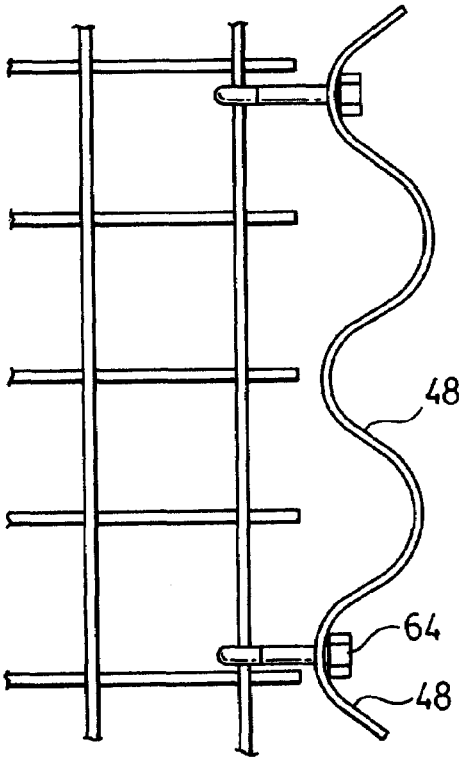
FIGS. 13*a* and 13*b* show yet a further alternate embodiment for connecting the reinforcement to the sidewall.
Figure 13B:
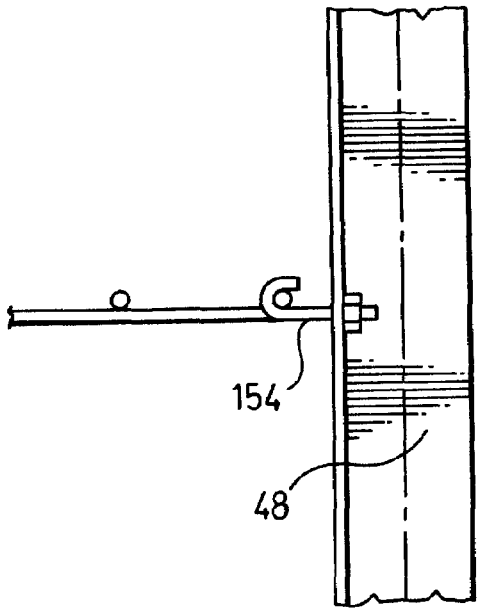

A further alternative configuration for the connection of the reinforcement to the arch-type structure is to use hook bolts 154 that capture the reinforcement. The application of backfill upon this connection maintains the reinforcement in place relative to the hook 154, eliminating the need for the reinforcement to be locked in position. Shown in FIGS. 12*a* and 12*b* is the use of hook bolts for connecting wire grid mat to the arch-type structure by way of an angle iron 62 to distribute the load. FIGS. 13*a* and 13*b* show the use of hook bolts 154 for connecting wire grid mat wherein the bolts are connected directly to the sidewall 48 of the arch-type structure.

It will be appreciated that for the various types of reinforcement the strips and/or grid may be made of any type of material (i.e. steel, aluminum, composites, plastics, etc) which has sufficient structural strength to resist movement in the sidewall of the erected structure during backfilling and subsequent usage. It will be further appreciated that a combination of reinforcements (i.e. a combination of wire grid mats and corrugated strips) could be used in a single installation. This provides maximum flexibility when engineering into the design the required load bearing characteristics.

In applications where there are two or more adjacent structures, each have similar beveled/skewed ends, the reinforcements discussed above could be configured to attach to one another between the adjacent structures, thereby providing a level of enhanced support. Alternatively, the reinforcements could be arranged to lie atop one another, without connection, or still further in a staggered, alternating configuration in the region between the structures, thereby strengthening the backfill contained therebetween.

While the above discussion has centered on an arch-type structure comprise of a plurality of interconnected structural metal plates to obtain the desired shape, the aforementioned reinforcement could be used with other corrugated metal plate technologies. It will be appreciated that the reinforcement described above could be used on similar structures wherein each span of structural metal plate defining the structures effective topside circumference is comprised of anywhere from a single length, to a plurality of lengths. Further, it will be appreciated that the geometry of the arch-type structure is not limited to those shown in the Figures, but may include any arch type structure including, but not limited to an ovoids, a re-entrant arch, a box culvert, round culvert or elliptical culvert.

It will be appreciated that while the above discussion refers to an arch-type structure having both a bevel and skew on a cut end, the aforementioned reinforcement may find application in structures that are solely beveled, or solely skewed. Further, it will be appreciated that while straight bevels and skews have been represented, inwardly or outwardly curved bevels and skews are also possible, It will also be appreciated that in providing a beveled/skewed cut end region, the cut section may be configured with either a smooth or stepped profile, as deemed appropriate for the particular application.

It will be noted that the completed arch-type structure shown in FIG. 1 has at each end a concrete collar. This collar not only provides a finished appearance to the structure, but also provides an additional amount of support to the beveled/skewed ends. It is important to note, however, that a significant advantage of this technology is that this collar is no longer the primary support for the beveled/skewed end. As such, this concrete collar is not required to be as robust as in prior art structures, thereby simplifying construction and reducing cost.

A further advantage of this technology is that the structural metal plates used can be of lighter gauge as the ability to withstand the pressures exerted by the backfill in the beveled/skewed region is assisted by the aforementioned reinforcements.

In applications where round pipes or culverts are used to direct a watercourse, there is a tendency at the ends of a beveled/skewed pipe for the extended portions of the pipe to rise upwards due to pressures exerted by the water flow. The ability to reinforce the cut end region of these pipes would assist in preventing this deformation which generally has the end result of completely and/or partially blocking the opening.

In accordance with the above discussed embodiments, arch-type structures comprising at least one beveled/skewed end may be erected and backfilled in an efficient controlled cost-effective manner. The backfilling procedure does not require special fill or special techniques other than those already commonly used in developing reinforced soils. The procedure for securing the reinforcement to the sidewalls is achieved in a variety of ways where localized stress on the structure is minimized. Such a structure greatly reduces costs because it is no longer required to 'over-engineer' the structure to withstand the stresses in the beveled/skewed region, nor are costly reinforcements such as concrete end caps and tie-backs with anchors required.

Although preferred embodiments of the invention have been described herein in detail, it will be understood by those skilled in the art that variations may be made thereto without departing from the spirit of the invention or the scope of the appended claims.

What is claimed is:

1. A method of controlling deformation of a cut end region of an erected arch-type structure for use in underpass construction, where the cut end region defines at least one extended leg portion, said method comprising:

i) building progressively a mechanically-stabilized earth structure adjacent said extended leg portion by alternately layering a plurality of compacted layers of fill with interposed layers of reinforcement generally to the height of said extended leg portion; and ii) securing to said extended leg portion each layer of reinforcement during said progressive building, whereby securement of said layers of reinforcement to said extended leg portion provides support in controlling deformation of the cut end region during backfilling and regular service.

2. The method of claim 1 wherein said cut end region defines extended leg portions on opposite sides of said arch-type structure and wherein said building and securing steps are performed for each extended leg portion.

3. The method of claim 2, further comprising positioning a load distributing device between each layer of reinforcement and each said extended leg portion to distribute load across each extended leg portion, thereby reducing point loads.

4. The method of claim 3, wherein said load distributing device is a segment of angle iron.

5. The method of claim 2, wherein each layer of reinforcement comprises at least one wire grid mat comprising interconnected rods.

6. The method of claim 5, wherein each layer of reinforcement extends laterally away from said arch-type structure in a generally horizontal configuration.

7. The method of claim 5, wherein at least one layer of reinforcement comprises a plurality of wire grid mats.

8. The method of claim 2, wherein each layer of reinforcement is maintained in position by frictional forces within said associated mechanically-stabilized earth structure.

9. The method of claim 2, wherein each layer of reinforcement is comprised of a plurality of strips.

10. The method of claim 2, wherein the layers of reinforcement are comprised of a combination of grid wire mats and plurality of strips and wherein each layer of reinforcement is maintained in position by frictional forces within said associated mechanically-stabilized earth structure.

11. The method of claim 2 wherein the extended leg portions are of different heights and wherein the mechanically-stabilized earth structures adjacent the extended leg portions have differing numbers of fill and reinforcement layers.

12. The method of claim 11, wherein said cut end region of said arch-type structure defines a bevelled or skewed configuration.

13. The method of claim 11, further comprising positioning a load distributing device between each layer of reinforcement and each said extended leg portion to distribute load across each extended leg portion, thereby reducing point loads.

14. The method of claim 13, wherein said load distributing device is a segment of angle iron.

15. The method of claim 11, wherein each layer of reinforcement comprises at least one wire grid comprising interconnected rods.

16. The method of claim 15, wherein each layer of reinforcement extends laterally away from said arch-type structure in a generally horizontal configuration.

17. The method of claim 15, wherein at least one layer of reinforcement comprises a plurality of wire grid mats.

18. The method of claim 11, wherein each layer of reinforcement is maintained in position by frictional forces within said associated mechanically-stabilized earth structure.

19. The method of claim 11, wherein each layer of reinforcement is comprised of a plurality of strips.

20. The method of claim 11, wherein the layers of reinforcement are comprised of a combination of grid wire mats and plurality of strips and wherein each layer of reinforcement is maintained in position by frictional forces within said associated mechanically-stabilized earth structure.

* * * * *